United States Patent [19]

Bauer

[11] 3,937,896

[45] Feb. 10, 1976

[54] COMPATIBLE FOUR CHANNEL RADIO BROADCAST AND RECEIVING SYSTEM

[75] Inventor: Benjamin B. Bauer, Stamford, Conn.

[73] Assignee: CBS Inc., New York, N.Y.

[22] Filed: Apr. 18, 1974

[21] Appl. No.: 462,044

[52] U.S. Cl. ..... 179/15 BT; 179/1 GQ

[51] Int. Cl.[2] ..... H04R 5/00

[58] Field of Search ..... 179/1 GQ, 15 BT

[56] References Cited

UNITED STATES PATENTS

| | | | |
|---|---|---|---|
| 3,761,628 | 9/1973 | Bauer | 179/1 GQ |
| 3,814,858 | 6/1974 | Parker | 179/15 BT |
| 3,875,338 | 4/1975 | Bauer | 179/1 GQ |

OTHER PUBLICATIONS

Discrete–Matrix Multichannel Stereo by Cooper et al., Paper Presented Mar. 1972, Central Europe Section Audio Engineering Society.

QFMX–Quadruplex FM Transmission Using the 4–4–4 QMX Matrix System by Cooper, Journal AES, Mar. 1974, pp. 82–87.

Compatible FM Broadcasting of Panoramic Sound by Gibson et al., AES Preprint Presented Sept. 15, 1972.

*Primary Examiner*—Kathleen H. Claffy
*Assistant Examiner*—Tommy P. Chin
*Attorney, Agent, or Firm*—Spencer E. Olson

[57] ABSTRACT

A compatible four channel system for use in conjunction with a radio transmission system for transmitting four individual audio signals over a medium having primary and secondary information channels and first and second subsidiary information channels, the primary and secondary channels carrying information that is consistent and compatible with existing monophonic and stereophonic standards.

13 Claims, 14 Drawing Figures

COMPATIBLE FOUR CHANNEL RADIO BROADCAST AND RECEIVING SYSTEM

BACKGROUND OF THE INVENTION

This invention relates to quadraphonic audio systems, and more particularly to systems for encoding four or more individual channels of audio information for broadcast over FM multiplex radio, and for decoding and reproducing the broadcast information either as four discrete audio output signals having the directionality of the original input signals or "semi-discretely" in the manner of matrix systems, the broadcast information being fully compatible with existing monophonic and stereophonic receivers. The subject matter of this application is related to subject matter in the co-pending application Ser. No. 462,042 entitled "Compatible Four Channel Recording And Reproducing System" filed of even date herewith and assigned to the same assignee as the present application.

The nature of the encoding employed in the "SQ" quadraphonic record system described in applicant's co-pending application Ser. No. 384,334 filed July 31, 1973, now U.S. Pat. No. 3,890,466, has made it possible to broadcast quadraphonic information over FM multiplex radio in a manner which is fully compatible with monophonic and stereophonic receivers. In a broadcast mode, the two composite signals transduced from an SQ record, each of which contains three of the four input signals with preselected amplitude and phase relationships, can be transmitted in the same manner as a conventional stereophonic signal pair. Upon reception, a conventional monophonic or stereophonic FM receiver gives the listener a totally satisfactory monophonic or stereophonic presentation, as the case may be. If an SQ decoder of the type described in applicant's co-pending application Ser. No. 338,691, filed Mar. 7, 1973, now U.S. Pat. No. 3,835,255, is used in combination with the stereophonic FM receiver, the listener can obtain four-channel reproduction of the four signals contained in the transmitted composite signals. It is a primary object of the invention to provide an improved system for broadcasting and receiving four independent channels discretely or semi-discretely, in a manner that is fully compatible with existing SQ decoders, as well as with existing stereophonic and monophonic receivers.

As further background for understanding the present invention and the differences between it and the more simplified method of SQ broadcasting alluded to above, it will be useful to discuss in further detail the characteristics and limitations of simply transmitting the two composite encoded signals. Employing the SQ system, the broadcaster can use an SQ encoder, of which several types are disclosed in applicant's co-pending application Ser. No. 384,334 filed July 31, 1973, for combining the four channels of a four-channel program, either live or taped, into two composite signals, and transmitting them through existing FM stereo transmitter equipment. This approach provides satisfactory results at the receiver as long as there are no soloists or important instruments placed in the center-back of the quadraphonic field. It is a characteristic of the SQ code that center-back signals are encoded in phase opposition and thus are not received through a monophonic receiver; however, they are reproduced normally with stereophonic FM receivers and properly decoded when an SQ code does not significantly handicap a record producer because he can be careful to avoid placing soloists in the "dead back" of the audience, and indeed, it may be to his advantage when recording symphonic music in highly reverberant halls. In the latter case, the orchestra is picked up normally with a conventional microphone array for transmission over the two front channels, while the reverberant energy received with additional microphones is distributed among the remaining three channel pairs so as to convey to the quadraphonic listener a realistic impression of the sounds of the hall. For the monophonic listener, however, with all the music and a full measure of reverberation concentrated in one loudspeaker, the reverberation tends to mask the fine structure of the music, producing "muddy" sound. With the basic SQ code the producer is able to concentrate a greater measure of reverberant energy predominantly between the back channels, thereby to cause it to be diminished in the monophonic mode to give a more satisfactory energy balance. The stereophonic listener, of course, hears all the signals but the anti-phase reverberant energy becomes distributed, at least in part, beyond the confines of the loudspeakers thus preserving a satisfactory direct/reverberant signal balance for the main-front stage.

Unfortunately, the broadcasting program director often does not have the opportunity to carefully plan and edit the material being encoded for broadcast. He may have to transmit any four-channel program through the SQ system, for example, from an existing tape, which might contain a center-back soloist; or a live rock concert during the broadcast of which an artist might wander between the back-channel microphones. To accommodate these contingencies, the broadcast producer can use the "forward-looking" encoder illustrated in FIG. 20 of the aforementioned co-pending application Ser. No. 384,334 which treats the center-back signal in an in-phase manner as if it were a center-front signal. Using this encoder, the sounds around the front and sides of the quadraphonic field, including left-back, left-front, center-front, right-front, and right-back channels are ideally coded, the signals between the back channels are redistributed among all the channels, and the center-back signal is moved forward to the center-front position. With this code, then, all listeners, monophonic, stereophonic and quadraphonic, hear all of the signals, but the quadraphonic listener perceives center-back signals as if they originated at center-front. In any event, it will be appreciated that the quadraphonic listener, using a matrix decoder, does not hear four discrete signals; each is "contaminated" to some degree with lower level signals from two other channels, as is inherent in "matrix" four-channel systems.

Although the above-described SQ system of broadcasting provides generally acceptable quadraphonic reproduction at the receiver, which can be further improved to approach the quality of discrete reproduction through the use of logic and control circuitry in conjunction with the matrix decoder, there is considerable current interest in providing a system for broadcasting four channels in a manner which allows fully discrete presentation at the receiver. Again, such a system should still retain full compatibility with conventional stereophonic and monophonic receivers and be capable of operation on frequency channels allocated by the Federal Communications Commission. To achieve these ends, one can first appropriately combine the four signals of the four-channel program into a two-channel mono-compatible stereophonic program for transmission over existing FM broadcast channels and also provide for transmission of at least two additional sets of signals which, upon reception followed by appropriate combination of received signals, will enable restoration of the original four program signals. In one proposed system of which applicant is aware, four audio signals are combined to form a pair of signals designated $(L_f + L_b)$ and $(R_f + R_b)$ and the sum and difference of these signals are transmitted by an FM multiplex transmitter. The four program signals are also combined into two additional signals $(L_f + R_f) - (L_b + R_b)$ and $(L_f + R_b) - (R_f + L_b)$ which are transmitted simultaneously as modulation on additional subcarriers. Upon reception, the four sets of signals are appropriately recombined to derive the original four audio signals $L_f$, $R_f$, $L_b$ and $R_b$; such recombination being possible as long as the sets are non-trivial and are linearly independent. A number of systems employing this basic scheme of signal combination, including the system described in Dorren U.S. Pat. No. 3,708,623, are currently being evaluated by the NQRC (National Quadraphonic Radio Committee). It is unnecessary for present purposes to discuss the merits of the above-described sets of signals, except to point out that each of them statistically carries equal amounts of power with the consequence that it is necessary to transmit a relatively high total signal energy to perform the "discretizing" operation.

While the advantages to be derived from "discrete" quadraphonic broadcasting are at this time inconclusive, and a variety of proposals are being considered, it would be disirable, in the event that a discrete system of quadraphonic broadcasting is adopted, that such systems be compatible with SQ decoders and decoder-equipped radio receivers currently in the hands of consumers. It is an object of the present invention to provide a four channel system of broadcasting which allows fully discrete reception, but which is also compatible with existing monophonic, stereophonic and SQ receiving and reproducing equipment. SUMMARY OF THE INVENTION The present invention is directed to a compatible four channel system for use in conjunction with a radio transmission system for transmitting four individual audio signals designated $L_f$, $L_b$, $R_b$, and $R_f$ over a medium having primarily and secondary information channels and first and second subsidiary information channels, the primary and secondary channels carrying information that is consistent and compatible with existing monophonic and stereophonic standards. In accordance with the preferred embodiment of the invention, means are provided for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other. Means are also provided for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other. First and second conjugates of the first and second composite signals, respectively, are formed, the first and second conjugates being designated $L_T^*$ and $R_T^*$. Means are provided for forming a sum signal as a function of the sum of $L_T$ and $R_T$ and for applying the sum signal to the primary information channel.

Means are also provided for forming a difference signal as a function of the difference between $L_T$ and $R_T$ and for applying the difference signal to the secondary information channel. Finally, means are provided for applying the first and second conjugates, $L_T^*$ and $R_T^*$, to the first and second subsidiary channels, respectively. In accordance with the preferred embodiment of the invention, a receiver/decoder is provided which includes means responsive to the primary and secondary channels for processing the sum and difference signals to obtain the first and second composite signals, $L_T$ and $R_T$. $L_T$ and $L_t^*$ are combined to recover the individual audio signal $L_f$. $R_T$ and $R_T^*$ are combined to recover the individual audio signal $R_f$. Also, means are provided for combining relatively phase shifted versions of the composite signals and the conjugates to recover the third and fourth individual audio signals, $R_b$ and $L_b$.

The original program signals can be encoded in a variety of ways to provide signals at the receiver necessary to accomplish the discretizing function, several of these ways being described hereinbelow. A feature of each of the described embodiments is that the signal energy in the auxiliary signals carrying the information necessary to accomplish descretizing is significantly lower than the signal energy in the channels carrying the principal information. As a consequence, the total signal energy that must be handled by the transmitter is lower than that required for other systems that have been proposed for discrete broadcasting of four channel program information.

Further features and advantages of the invention will become more readily apparent from the following detailed description when taken in conjunction with the accompanying drawings.

DESCRIPTION OF THE PREFERRED EMBODIMENTS

Figure 1:
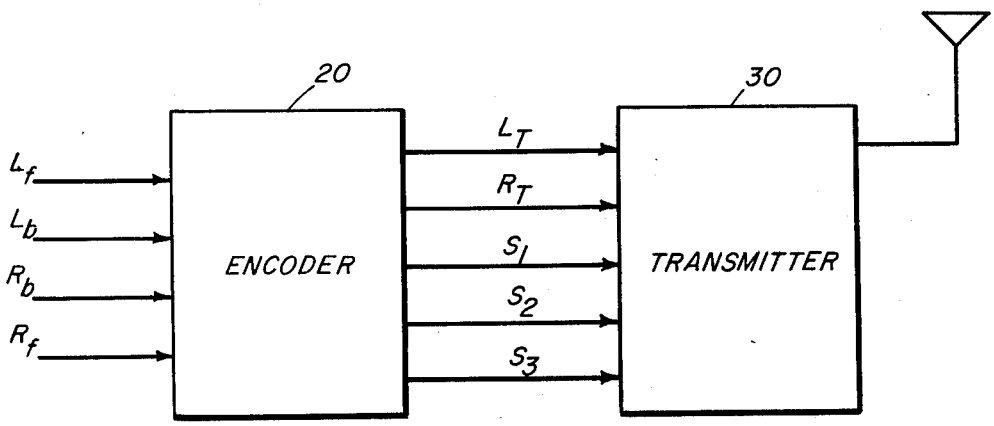
FIG. 1 is a simplified block diagram of a transmitter system embodying the present invention.

Referring to FIG. 1, there is shown a simplified block diagram of an SQ-compatible FM transmitter system that is responsive to four independent audio signals designated $L_f$, $L_b$, $R_b$, and $R_f$. This transmitter transmits FM signals that are compatible with existing monophonic, stereophonic and SQ standards for consumers who have such equipment. The transmitted FM also includes auxiliary signals, designated $S_1$, $S_2$, and $S_3$ that can be processed by consumers having appropriate decoding equipment. As will become apparent, consumers having a certain type of decoding equipment will be capable of recovering the four original audio signals in fully discrete form, whereas consumers having another type of decoding equipment will be capable of obtaining four audio signals that are in "semi-discrete" form; i.e., that have greater relative separation than ordinary decoded SQ outputs, but which are not fully discrete. Such semi-discrete outputs will be sometimes referred to hereinafter as being "enhanced". As will also become apparent, various options will be available at the transmitter regarding the number of auxiliary signals to be transmitted and the nature of these signals, depending upon the type of broadcasting objectives that are desired.

The four independent audio signals $L_f$, $L_b$, $R_b$ and $R_f$ are received by an encoding block 20 which includes, inter alia, an SQ encoder for producing SQ composite signals designated $L_T$ and $R_T$ and additional encoding circuitry for generating the auxiliary signals designated $S_1$, $S_2$, and $S_3$. As is well known, existing stereophonic multiplex transmitters add the total left and right audio information to produce a sum signal called a main or "primary information signal" (for a particular FM station) which occupies the portion of the frequency spectrum lying between about 50Hz and 15 kHz. Also, a difference signal is formed by subtracting the total right audio information from the total left audio information and this difference is used to modulate a suppressed sub-carrier at 38 kHz. The result is a suppressed-carrier double side band signal called a "secondary information signal" centered at 38 kHz and occupying the frequency range from about 23 kHz to 53 kHz of the frequency spectrum. A 19 kHz pilot signal is also provided to enable detection of 38 kHz sidebands. In some cases, there is additionally broadcast a "Subsidiary Communication Authorization" ("SCA") signal at 67 kHz, although it has been suggested that this SCA signal could be eliminated for stations where four independent audio signals are to be transmitted discretely or semi-discretely.

In the present invention the composite SQ signals $L_T$ and $R_T$ serve as left (total) and right (total) audio signals, respectively, and are encoded and then applied to the primary and secondary channels of a station in conventional fashion as primary and secondary information signals. As previously indicated, consumers having existing monophonic and stereophonic equipment or existing SQ equipment and who can receive $L_T$ plus $R_T$ only (in the monophonic case) or who are able to obtain $L_T$ and $R_T$ separately (as in the stereophonic case) will be able to do so without loss of compatibility. Of course, consumers who also have SQ decoding equipment will be able to further process the composite signals $L_T$ and $R_T$ to obtain four decoded SQ signals as is described in detail in the above-referenced co-pending applications. The auxiliary signals $S_1$, $S_2$, and $S_3$ can be employed in various ways to cause modulation over selected remaining portions of the frequency spectrum associated with the station being broadcast. This is illustrated with the aid of FIG. 2A which is a diagramatic representation of the manner in which auxiliary signals can be used to modulate subcarriers to obtain various frequency distributions within a station allocation. The baseband or primary information signal ($L_T + R_T$) is seen to occupy a frequency range from about 50 Hz to 1500 Hz in the conventional manner. Also, the secondary information signal, i.e. the difference signal ($L_T - R_T$), is seen to occupy the frequency range from 23 to 53 KHz. These two channels of information, plus the pilot shown at 19 kHz, are the necessary constituents for the transmission of conventional stereophonic signals.

Figure 2A:
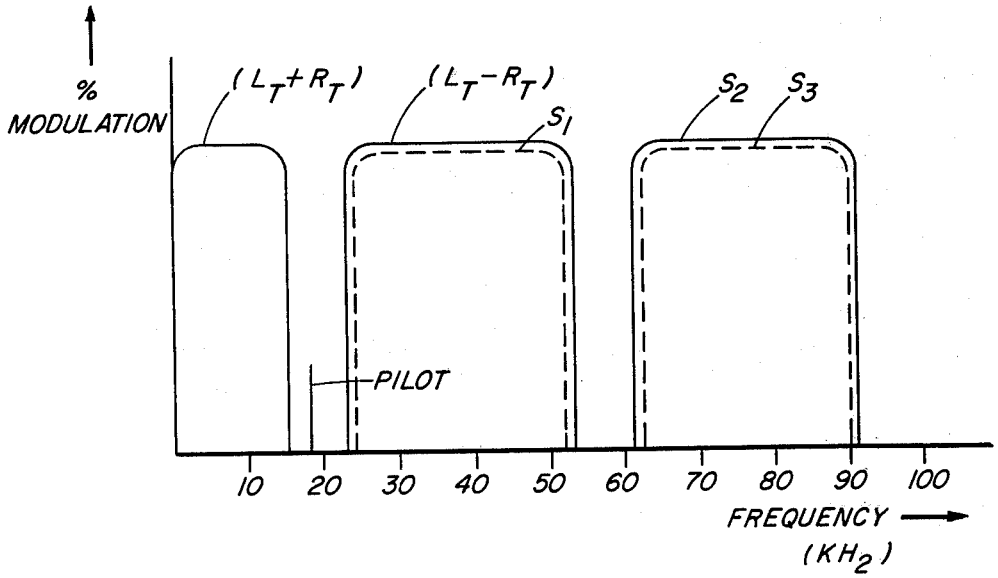
FIG. 2A is a diagram showing the frequency spectrum of a composite signal employed for the transmission of four channel information.

Another frequency band, also occupying the range 23 to 53 kHz, can be obtained by modulating the suppressed 38 kHz subcarrier in a quadrature relationship with respect to the previously described modulation of said subcarrier by the difference signal ($L_T - R_T$). In FIG. 2A, an auxiliary signal designated $S_1$ is employed for this quadrature modulation so as to yield frequency band shown in dashed line. Also, a 76 kHz subcarrier can be modulated in quadrature by two other auxiliary signals designated $S_2$ and $S_3$. The two resulting frequency bands, shown in solid and dashed lines, occupy the spectral range 61 to 91 kHz and can be ultimately recovered using a multiple of the transmitted 19 kHz pilot signal.

Figure 2B:
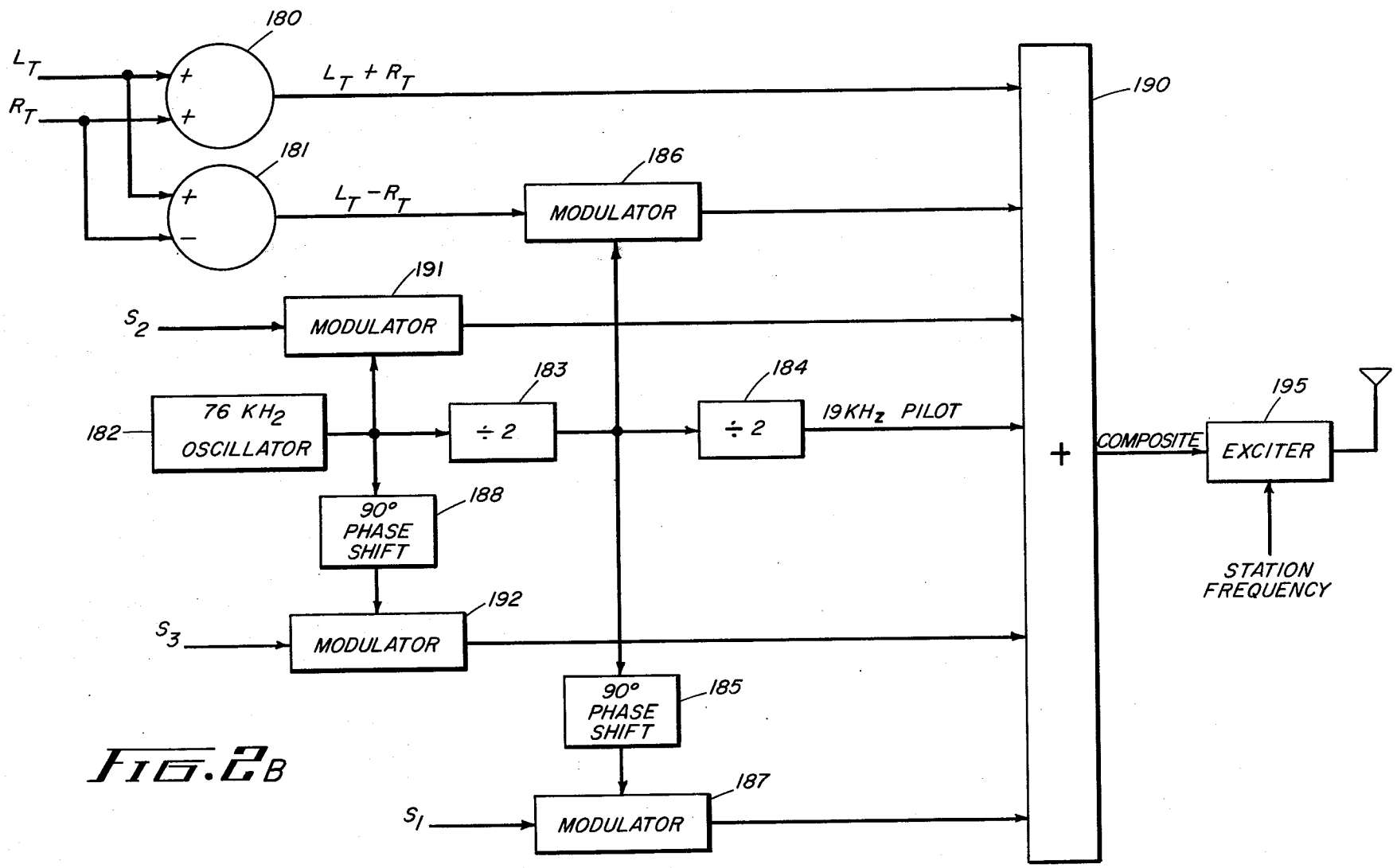
FIG. 2B is a block diagram of transmitter for four channel information.

FIG. 2B is a simplified block diagram of a transmitter 30 that can be employed to obtain an FM signal having a frequency spectrum as set forth in FIG. 2A. Briefly, the sum and difference of $L_T$ and $R_T$ are formed by the summing circuits 180 and 181 and the sum ($L_T + R_T$) is applied to an input terminal of adder 190. Am oscillator 182 provides an output at 76 kHz and frequency dividers 183 and 184 are employed in series to make available the characteristic frequencies of 38 kHz and 19 kHz. The 19 kHz output, used as a pilot signal, is coupled to another input terminal of adder 190. The 38 kHz output, and a quadrature version thereof formed using 90° phase shifter 185, are coupled to suppressed-carrier type modulators 186 and 187 which modulate the 38 kHz subcarriers with the difference signal ($L_T - R_T$) and $S_1$, respectively. The outputs of modulators 186 and 187 are coupled to input terminals of adder 190. Similarly, the 76 kHz output, and a quadrature version thereof formed using 90° phase shifter 188, are coupled to suppressed-carrier type modulators 191 and 192 which modulate the 76 kHz subcarriers with $S_2$ and $S_3$ respectively.

The outputs of these modulators are coupled to further input terminals of adder 190. The output of adder 190 is a composite signal having a frequency spectrum as shown in FIG. 2A, and this composite is coupled to an exciter 195 where it is used to frequency modulate the station frequency.

Figure 3:
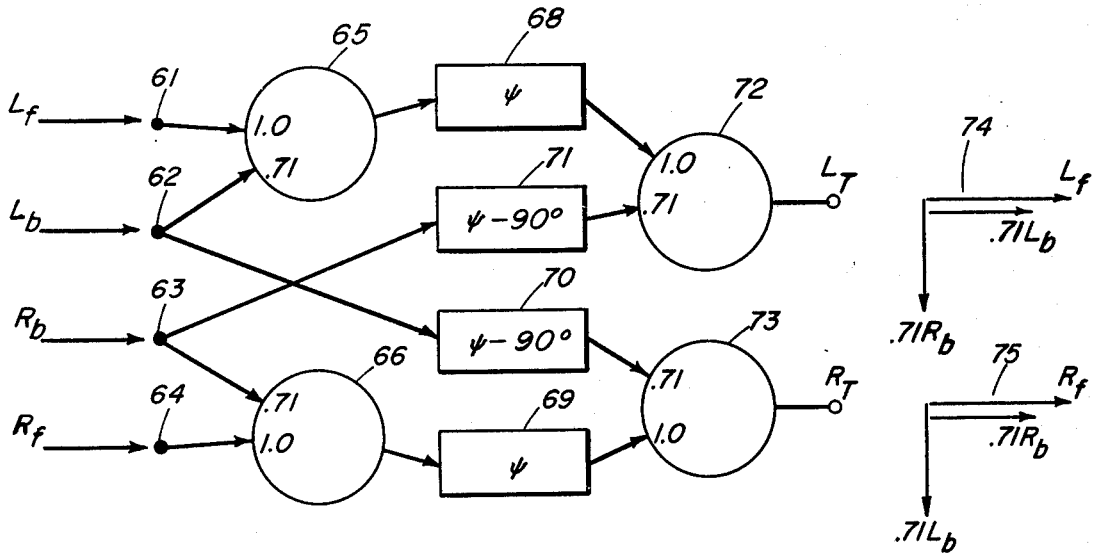
FIG. 3 is a block diagram of an encoding matrix useful in the system of FIG. 1.

The encoder 20 includes a matrix of the type disclosed in applicant's above-referenced co-pending application Ser. No. 384,334 and shown in FIG. 3. The matrix has four input terminals 61, 62, 63 and 64 which respectively receive the four independent audio signals $L_f$, $L_b$, $R_b$ and $R_f$ which are available as inputs to the encoder 20 (FIG. 1). Phasor representations of these four signals are depicted next to their respective input terminals. As described in detail in the referenced application, the $L_f$ signal is added to 0.71 of the $L_b$ signal by the summing circuit 65 and the output is applied to an all-pass phase shifter 68 which introduces a reference phase shift $\psi$ at all frequencies of interest. The $R_f$ signal at input terminal 64 is added to .71 of the $R_b$ signal by the summing circuit 66 and the output is applied to an all-pass phase shifter 69 which also introduces a reference phase shift $\psi$. The $L_b$ and $R_b$ signals are also applied to respective all-pass phase shift networks 70 and 71, each of which provides a phase shift of ($\psi + 90°$). The output of network 68 is added to 0.71 of the output of network 71 by summing circuit 72 to produce the composite signal $L_T$. Similarly, the output of network 69 is added to 0.71 of the output of network 70 by summing circuit 73 to produce the composite signal $R_T$. The encoder of FIG. 3 is of the "forward-looking" type referred to in the Background and produces the composite signals $L_T$ and $R_T$ illustrated by the phasor groups 74 and 75. Characteristically, $L_T$ includes $L_f$ in a dominant proportion and $L_b$ and $R_b$ in subdominant proportions (0.71) and in phase quadrature with respect to each other while $R_T$ includes $R_f$ in a dominant proportion and $R_b$ and $L_b$ in subdominant proportions and in phase quadrature with respect to each other. Using conventional phasor notation, the composite signals can be represented by the equations $$L_T = L_f + 0.71L_b - j\,0.71R_b$$
$$R_T = R_f + 0.71R_b - j\,0.71L_b$$

Figure 4A:
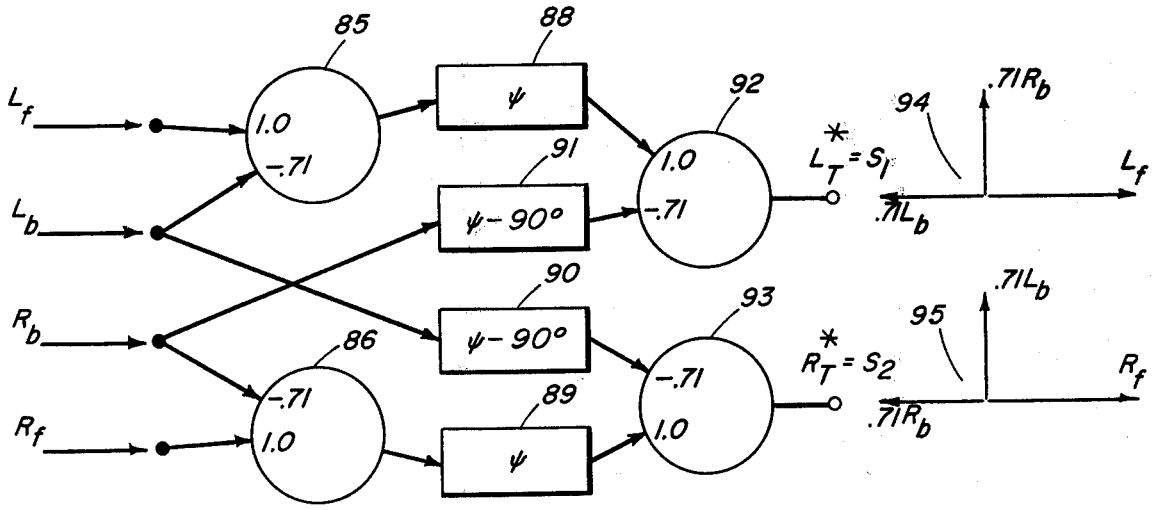
FIG. 4A is a block diagram of another encoding matrix.

Having developed the outputs $L_T$ and $R_T$ of encoder 20, we turn now to the development of the auxiliary signal outputs $S_1$, $S_2$ and $S_3$. As previously noted, there are various options available at the transmitter regarding the number of auxiliary signals to be transmitted and the nature of these signals, depending on the broadcasting objectives desired. Referring to FIG. 4A, the firsst of these options is set forth wherein two auxiliary signals, $S_1$ and $S_2$, are transmitted and allow consumers capable of receiving them to recover the four independent audio signals in fully discrete form. In FIG. 4A the developed auxiliary signals are "conjugates" of the composite signals $L_T$ and $R_T$ and are given the disignations $L_T$* and $R_T$*, respectively. For purposes of this application, the conjugate of a given composite signal is defined as a signal which when added to or subtracted from the given composite signal yields a result which contains only the component that had been predominant in the given composite signal. In other words, the sub-dominant components of the given composite signal and its conjugate are proportioned and oriented so as to cancel. In FIG. 4A the developed conjugates $L_T$* and $R_T$* are represented by the phasor groups 94 and 95, respectively. The equations for the conjugates are $$L_T = L_f - 0.71L_b + j\,0.71R_b$$
$$R_T = R_f - 0.71R_b + j\,0.71L_b$$

It can be readily seen that when $L_T$* is added to $L_T$ the sum contains only the component $L_f$ and when $R_T$* is added to $R_T$ the sum contains only the component $R_f$. The conjugates $L_T$* and $R_T$* (which serve as auxiliary signals $S_1$ and $S_2$ in this embodiment) are developed using the matrix of FIG. 4A which includes summing circuits 85, 86, 92 and 93 as well as all-pass phase shift networks 88, 89, 90 and 91. This matrix is similar to that of FIG. 3A except that negative portions of $L_b$ and $R_b$ are taken by the summing circuits. It should be noted that all $\psi$'s are substantially identical over the frequency range of interest.

Figure 5:
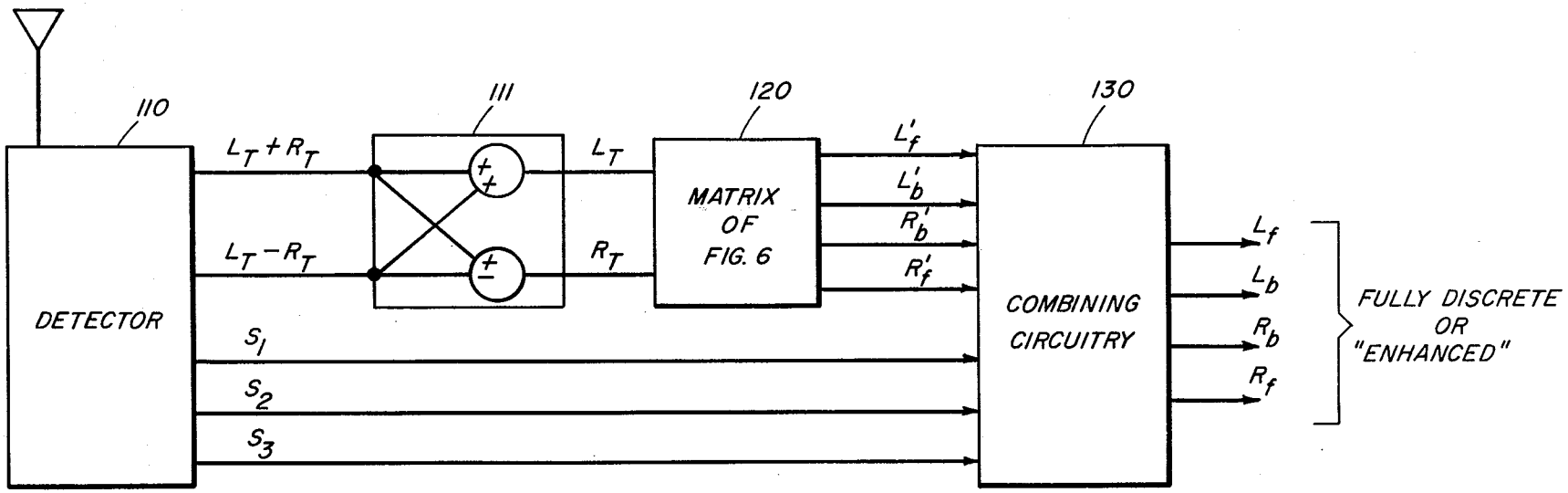
FIG. 5 is a block diagram of a receiving system in accordance with the invention.

FIG. 5 is a generalized block diagram of a receiver in accordance with the present invention. A detector 110 operates to detect and demodulate the signals described in conjunction with FIG. 2; viz., $(L_T + R_T)$, $(L_T - R_T)$, $S_1$, $S_2$, and $S_3$. The primary information signal, $(L_T + R_T)$, and the secondary information signal, $(L_T - R_T)$, are coupled to a sum/difference matrix 111 which yields the original composite dignals $R_T$ and $L_T$. These composite signals are coupled to an SQ decoder matrix 120 which may be of various types as set forth in applicant's above-referenced co-pending U.S. application Ser. No. 338,691. The matrix 120 produces four output signals designated $L_f'$, $L_b'$, $R_b'$ and $R_f'$ which respectively contain, in dominant proportion, the original independent audio signals $L_f$, $L_b$, $R_b$ and $R_f$. Each one of the four output signals also contains, in sub-dominant proportion, two "unwanted" components from among the four original signals. The four output signals from matrix 120 are coupled to combining circuitry 130 which also receives the auxiliary signals $S_1$, $S_2$ and $S_3$ from FM detector 110. Using the auxiliary signals, the circuitry 130 does further processing to obtain the four original audio signals in discrete form or to obtain enhanced audio signals as will be described.

Figure 6:
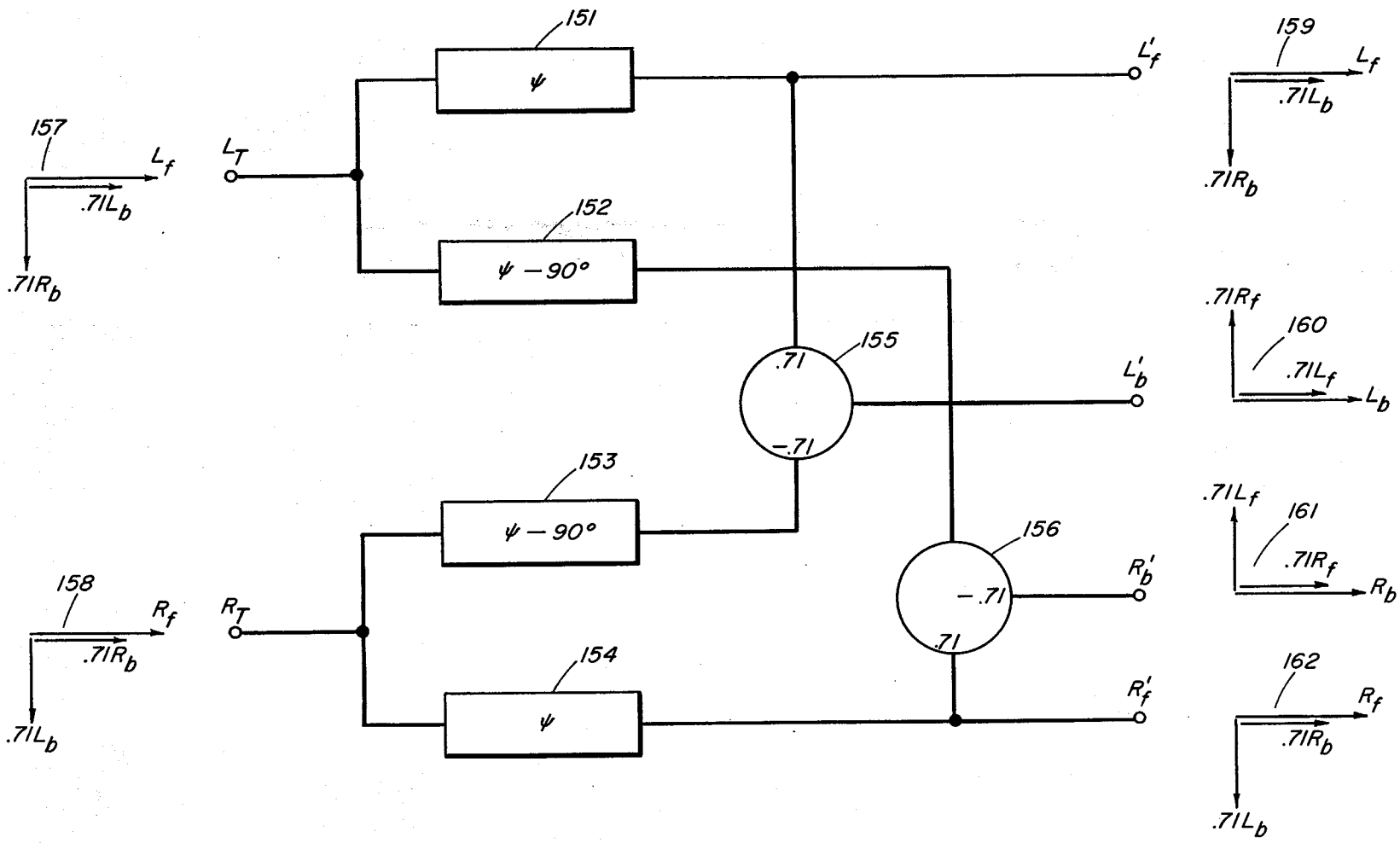
FIG. 6 is a decoder matrix useful as a part of the receiving system of FIG. 5.

A suitable decoder matrix 120 is illustrated in FIG. 6 which shows a matrix that is functionally the same as one disclosed in the above-referenced co-pending application Ser. No. 338,691. Four all-pass phase shift networks 151, 152, 153 and 154 and a pair of summing circuits 155 and 156 are arranged in the manner shown to decode $L_T$ and $R_T$ and obtain the four output signals $L_f'$, $L_b'$, $R_b'$, and $R_f'$. The phasor groups 157 and 158 represent $L_T$ and $R_T$, respectively, and the phasor groups 159, 160, 161 and 162 represent the decoded outputs $L_f'$, $L_b'$, $R_b'$ and $R_f'$, respectively. In equation form, the decoded outputs can be expressed as follows:

$$L_f' = L_f + 0.71L_b - j\,0.71R_b$$
$$L_b' = L_b + 0.71L_f + j\,0.71R_f$$
$$R_b' = R_b + 0.71R_f + j\,0.71L_f$$
$$R_f' = R_f + 0.71R_b - j\,0.71L_b$$

Figure 4B:
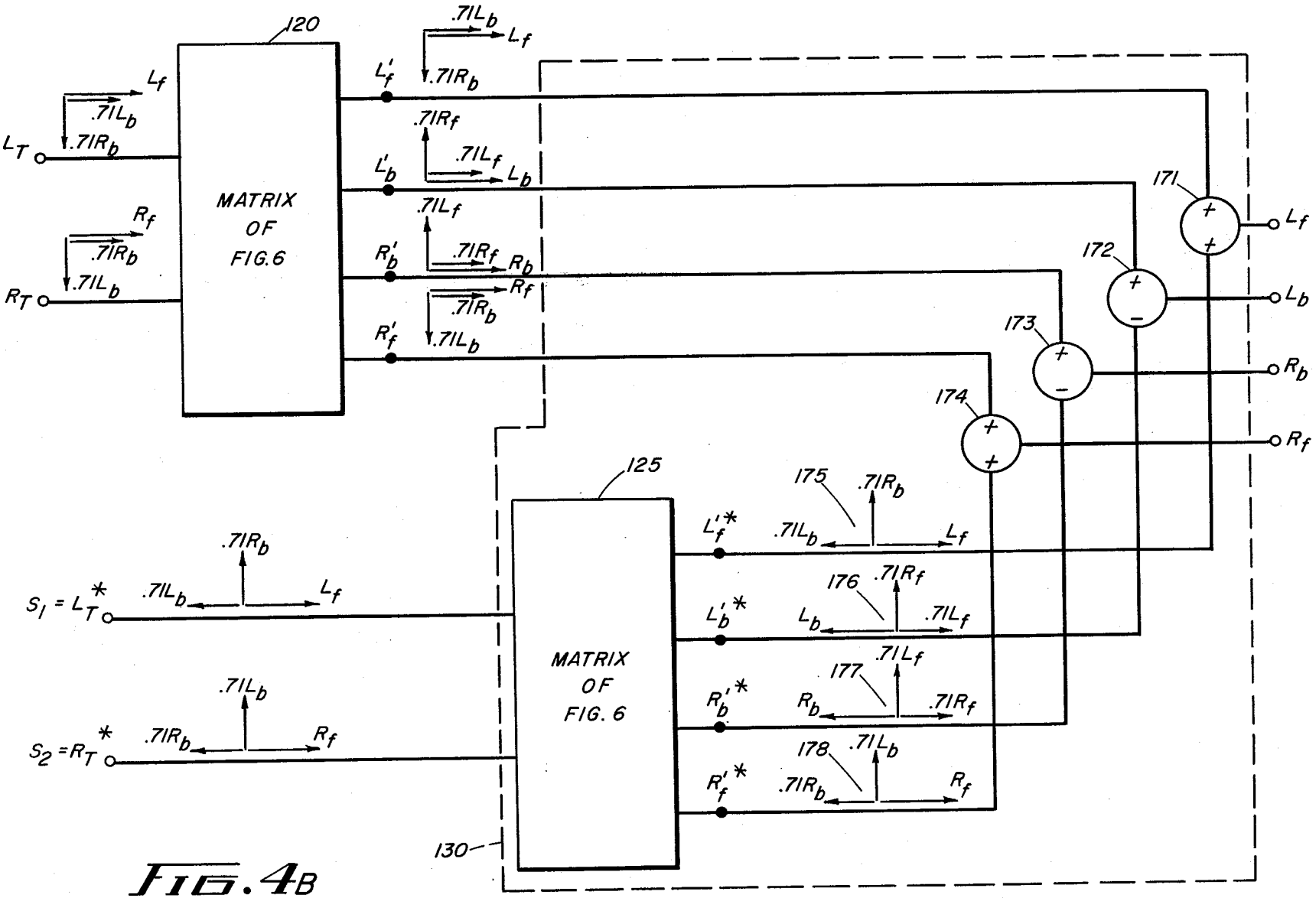
FIG. 4B is a block diagram of the combining circuitry portion of the receiver of FIG. 5.

FIG. 4B details the nature of the combining circuitry 130 (of FIG. 5) which can be employed when $S_1$ and $S_2$ are transmitted as the conjugates of $L_T$ and $R_T$ as described with reference to FIG. 4A. The circuitry 130 is shown in dashed enclosure and includes a matrix 125 and summing circuits 171 through 174. The auxiliary signals $S_1$ and $S_2$, which are equal to $L_T$* and $R_T$* in this embodiment, are coupled to an SQ decoder matrix 125 that is identical to the matrix 120 described in conjunction with FIG. 6. With these conjugates as inputs, the outputs of the matrix 125 are as illustrated by the phasor groups 175 through 178 and can be represented by the following equations $$L_f' = L_f - 0.71L_b + j\,0.71R_b$$
$$L_b' = -L_b + 0.71L_f + j\,0.71R_f$$
$$R_b' = -R_b + 0.71R_f + j\,0.71L_f$$
$$R_f' = R_f - 0.71R_b + j\,0.71L_b$$

The summing circuit 171 adds $L_f'$ to $L_f'$* to obtain an output which contains only the original audio signal $L_f$. The summing circuit 172 adds $L_b'$ to $L_b'$* to obtain an output which contains only the original audio signal $L_b$. Similarly, the summing circuits 173 and 174 respectively add $R_b'$ to $-R_b'$* and $R_f'$ to $R_f'$* to obtain outputs which contain only the original audio signals $R_b$ and $R_f$. These results follow from the above equations from which it is clear that $$L_f' + L_f'^* = 2L_f$$
$$L_b' - L_b'^* = 2L_b$$
$$R_b' - R_b'^* = 2R_b$$

$R_f' + R_f'^* = 2R_f$

Figure 7A:
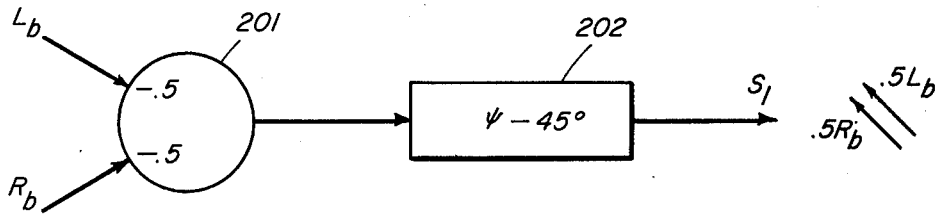
FIG. 7A is a block diagram of a circuit used to generate an auxiliary signal in accordance with the invention.
Figure 7B:
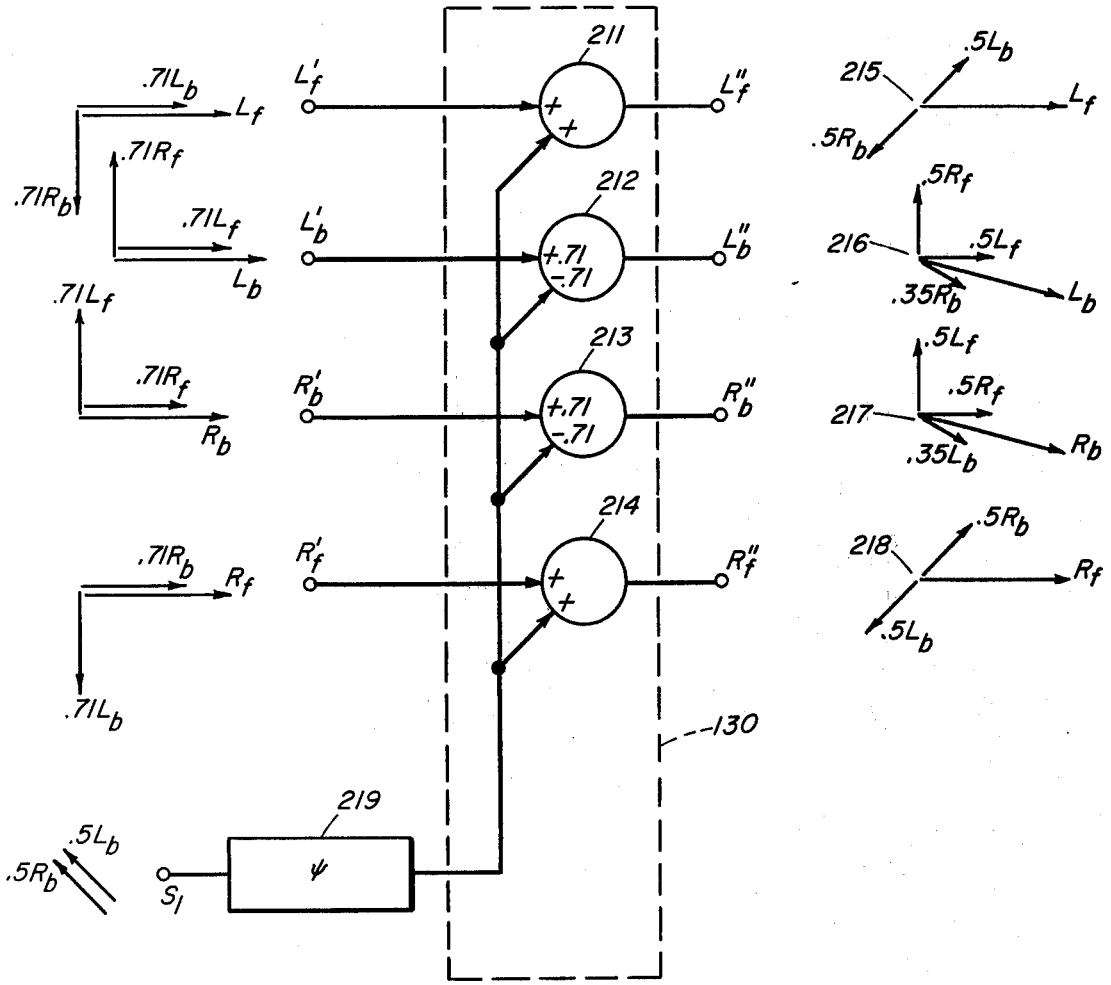
FIG. 7B is a diagram of the combining circuitry of FIG. 5 in accordance with a particular embodiment of the invention.

FIGS. 7A and 7B illustrate an embodiment wherein only a single auxiliary signal, $S_1$, need be transmitted (e.g., by quadrature modulation of the subcarrier at 38 kHz) and this auxiliary signal can be utilized by consumers having relatively simple combining circuitry 130 to obtain significantly enhanced audio output signals. FIG. 7A shows the portion of encoder block 20 (FIG. 1) which is used to generate $S_1$ for this embodiment. A summing circuit 201 adds $-0.5L_b$ to $-0.5R_b$ and this sum is phase shifted ($\psi - 45°$) by an all phase network 202. At the receiving end, the detector 110 (FIG. 5) recovers $S_1$ which is coupled via all-pass phase shift network 219 to combining circuit 130 along with the decoded SQ outputs $L_f'$, $L_b'$, $R_b'$ and $R_f'$. As shown in FIG. 7B, the combining circuit 130 for this embodiment includes four summing circuits labeled 211 through 214. The network 219 introduces a reference phase shift $\psi$ to $S_1$. This establishes the proper phase reference for $S_1$ since all the decoded SQ outputs had experienced this same reference phase shift during decoding (see FIG. 6). The four enhanced outputs, designated $L_f''$, $L_b''$, $R_b''$ and $R_f''$ can be seen to have the following formulations:

$$L_f'' = L_f' + S_1$$
$$L_b'' = 0.7L_b' - 0.7S_1$$
$$R_b'' = 0.7R_b' - 0.7S_1$$
$$R_f'' = R_f' + S_1$$

The phasor representations of the enhanced outputs are illustrated by phasor groups 215 through 218. In addtion to infinite front separation, the enhanced outputs exhibit 6dB separation from front-to-back and 9dB separation between the back channels. Thus, front-to-back separation is about twice the separation normally achieved with ordinary SQ decoded outputs.

Figure 8A:
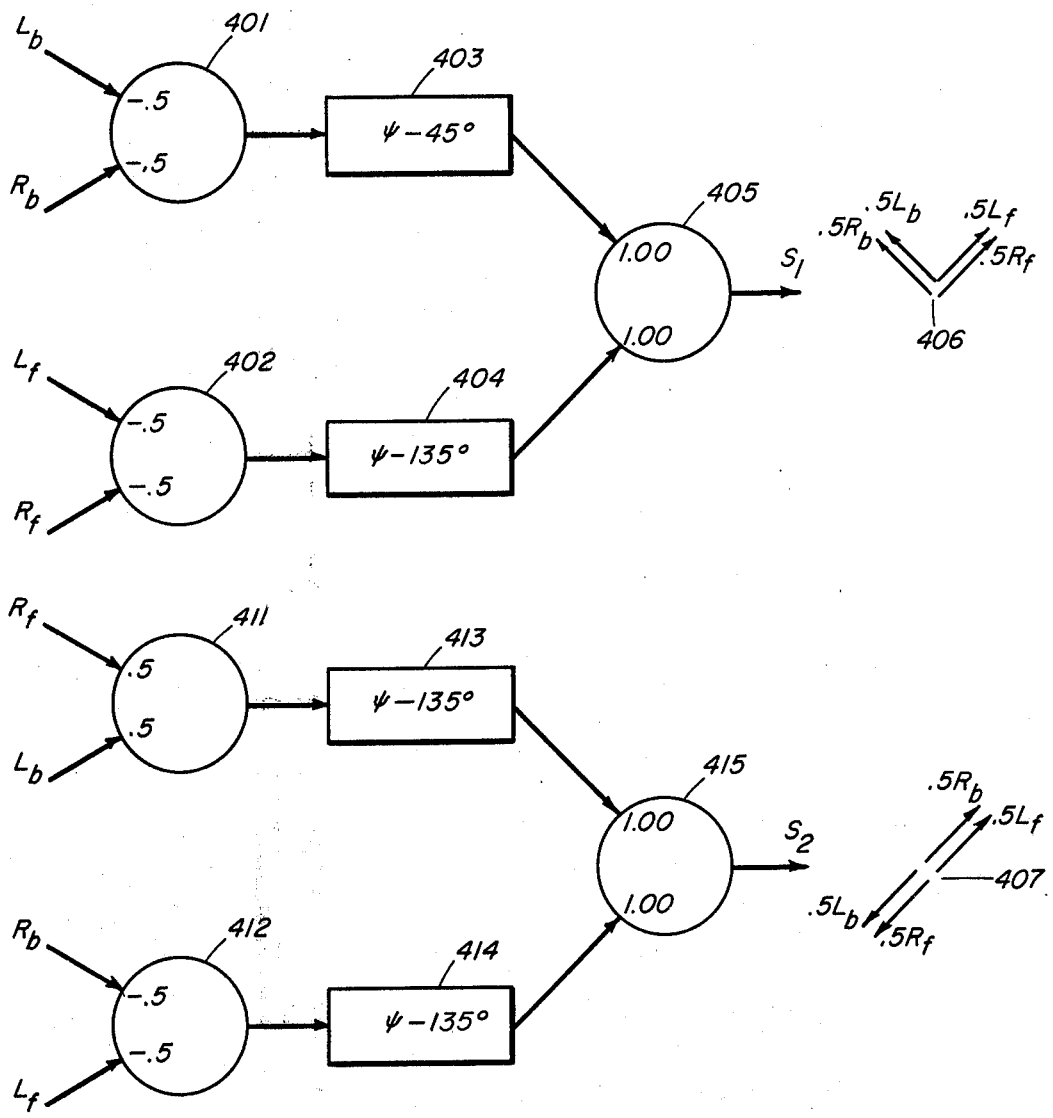
FIG. 8A is a block diagram of circuitry used to generate auxiliary signals in accordance with an embodiment of the invention.
Figure 8B:
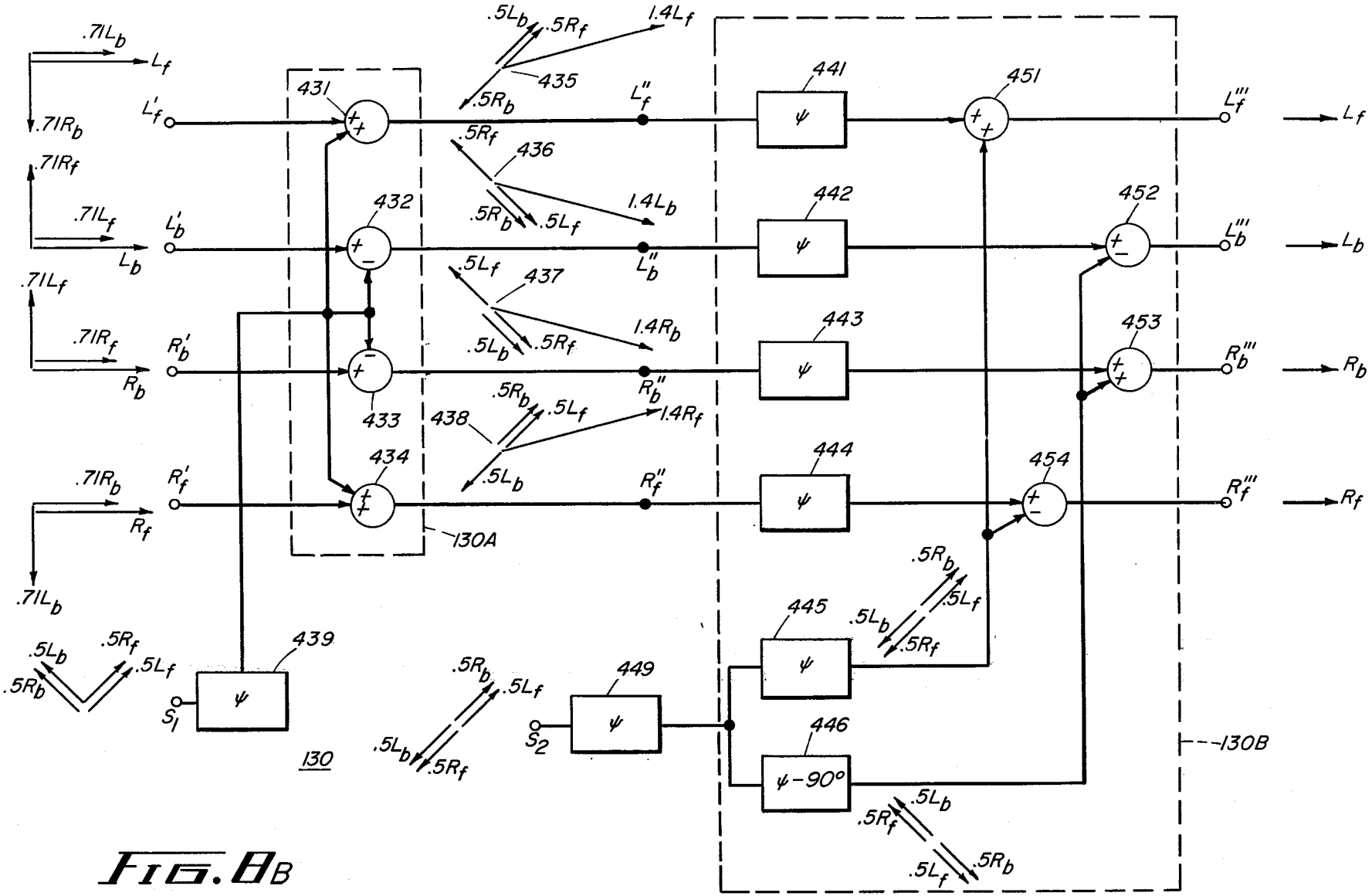
FIG. 8B is a diagram of the combining circuitry of FIG. 5 in accordance with another embodiment.

FIGS. 8A and 8B illustrate an embodiment of the invention wherein a pair of auxiliary signals, $S_1$ and $S_2$, are transmitted, and these auxiliary signals are utilized by consumers having a certain type of combining circuitry 130 to recover the original four independent audio signals in fully discrete form. This is the same type of operation that was performed in the embodiment described in conjunction with FIGS. 4A and 4B. In the present embodiment, however, an added advantage is that certain consumers having less sophisticated (and less expensive) combining circuitry can utilize only one of the two transmitted auxiliary signals to obtain significantly enhanced audio output signals while consumers having a more sophisticated type of combining circuitry can utilize both auxiliary signals to obtain fully discrete audio output signals. Thus an advantage of greater flexibility is achieved and the consumer is given viable purchase options. FIG. 8A shows the portion of encoder block 20 (FIG. 1) which is used to generate $S_1$ and $S_2$ for this embodiment. $S_1$ is generated using a pair of summing circuits 401 and 402 to respectively form the signals ($-0.5L_b - 0.5R_b$) and ($-0.5L_f - 0.5R_f$). The former signal is passed through an all-pass phase shift network 403 which introduces a relative phase shift of ($\psi - 45°$) and the latter signal is passed through an all-pass phase shifter 404 which introduces a relative phase shift of ($\psi - 135°$). The outputs of these phase shifting networks are added by summing circuit 405 to produce the auxiliary signal $S_1$ which is illustrated by the phasor group labeled 406. The auxiliary signal $S_2$ is formed in a similar manner. In this case, summing circuits 411 and 412 are used to form signals ($0.5R_f + 0.5L_b$) and ($-0.5R_b - 0.5L_f$). The outputs of the summing circuits are coupled through all-pass phase shift networks 413 and 414 which introduce relative phase shifts of ($\psi - 135°$). The resultant signals are added by summing circuit 415 to produce auxiliary signal $S_2$ shown by phasor grouping 407. It can be noted that each of the auxiliary signals $S_1$ and $S_2$ contains a component of each of the four original independent audio signals but that the phase relationships are different in the two auxiliary signals. Again, at the receiving end, detector 110 (FIG. 5) recovers $S_1$ and $S_2$ which are coupled via reference phase shifters 439 and 449 to combining circuit 130 along with the decoded SQ (FIG. 8B) outputs $L_f'$, $L_b'$, $R_b'$ and $R_f'$. As shown in FIG. 8B, the combining circuit 130 consists of two stages 130A and 130B, each being shown in a dashed enclosure. The stage 130A consists of four summing circuits labeled 431 through 434. As shown, the summing circuits are used to combine $L_f'$, $L_b'$, $R_b'$ and $R_f'$ in accordance with the following relationships:

$$L_f'' = L_f' + S_1$$
$$L_b'' = L_b' - S_1$$
$$R_b'' = R_b' - S_1$$
$$R_f'' = R_f' + S_1$$

The outputs of stage 130A are represented by the phasor groupings labeled 435 through 438. It will be appreciated that the outputs of the stage 130A can be utilized as the final audio outputs by consumers whose combining circuitry consists solely of the stage 130A. These outputs exhibit channel separation of 9dB for all adjacent channels. The stage 130A requires only the four relatively inexpensive summing circuits and the phase shifter 439, so a consumer who chooses this compromise can obtain enhanced SQ outputs without undue expense.

Consumers having the more sophisticated combining circuitry 130 will have a second stage 130B which receives the four outputs $L_f''$, $L_b''$, $R_b''$, and $R_f''$, and couples each of these outputs through respective all-pass phase shift networks 441 through 444, each of these phase shift networks introducing a reference phase shift of $\psi$. The auxiliary signal $S_2$ is coupled through reference phase shift network 449 to a pair of phase shift networks 445 and 446, the network 445 introducing a reference phase shift of $\psi$ and the network 446 introducing a relative phase shift of ($\psi - 90°$). Four summing circuits 451 through 454 are also provided in the stage 130B. The summing circuit 451 adds the output of phase shifting network 441 to $S_2$. As a result of this addition, the components $L_b$, $R_b$ and $R_f$ all cancel out and the resultant output, $L_f'''$, equals $L_f$, the original independent audio signal. Similarly, the output of network 445 is subtracted from the output of network 444 by summing circuit 454 to obtain $R_f'''$ which equals $R_f$, the original independent audio signal. The output of all-pass phase shift network 446 is added to the output of phase shift network 443 by summing circuit 453 to obtain $R_b'''$ which equals $R_b$, the original independent audio signal. Finally, the output of network 446 is subtracted from the output of network 442 to obtain $L_b'''$ which equals $L_b$, the original independent audio signal. Thus, by employing seven additional all-pass phase shift networks and four additional summing networks, a consumer having the full equipment can further discretize the outputs of the first stage 130A to obtain four fully discrete audio signals.

Figure 9A:
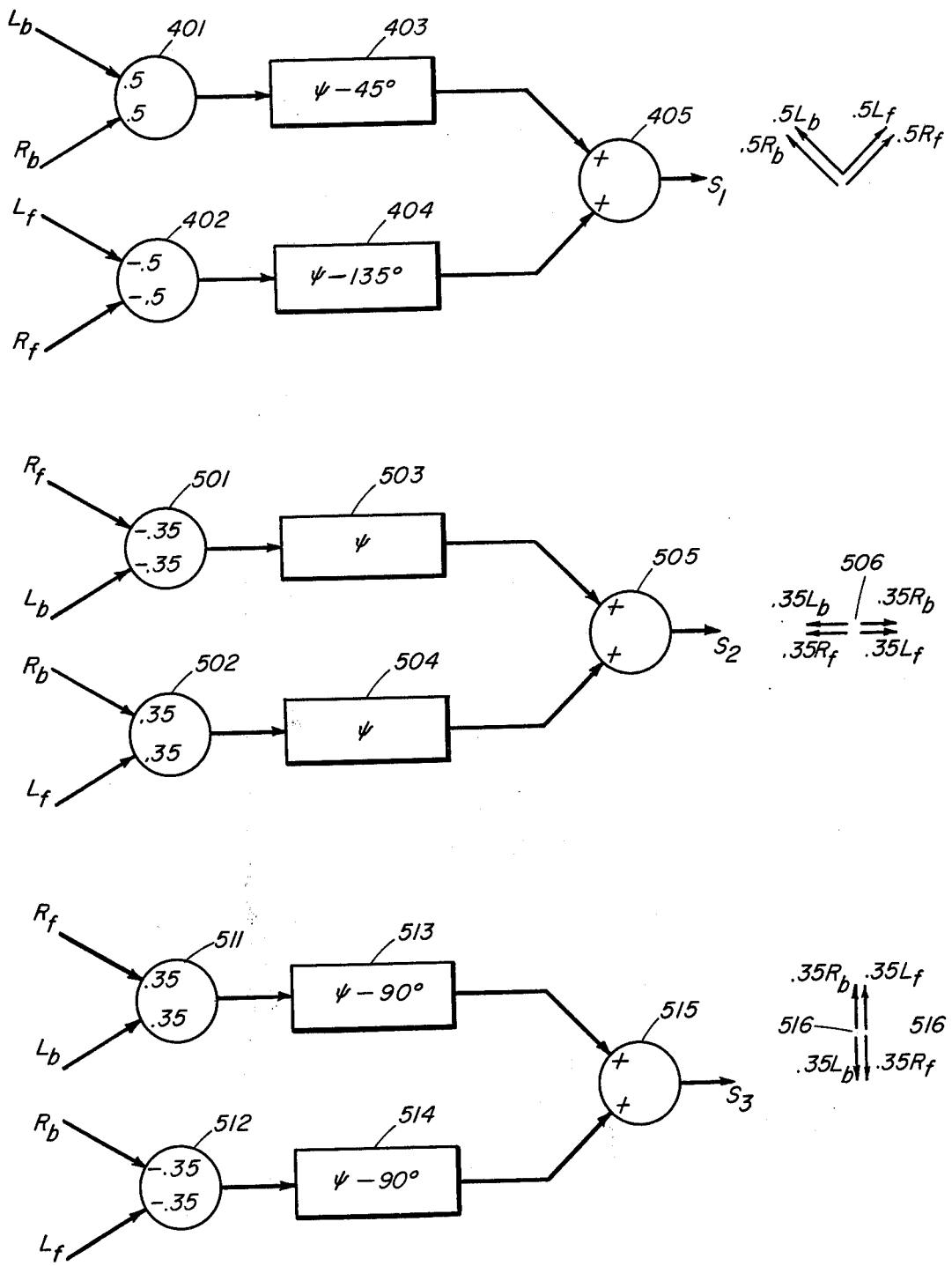
FIG. 9A is a block diagram of circuitry used to generate auxiliary signals in accordance with still another embodiment of the invention.
Figure 9B:
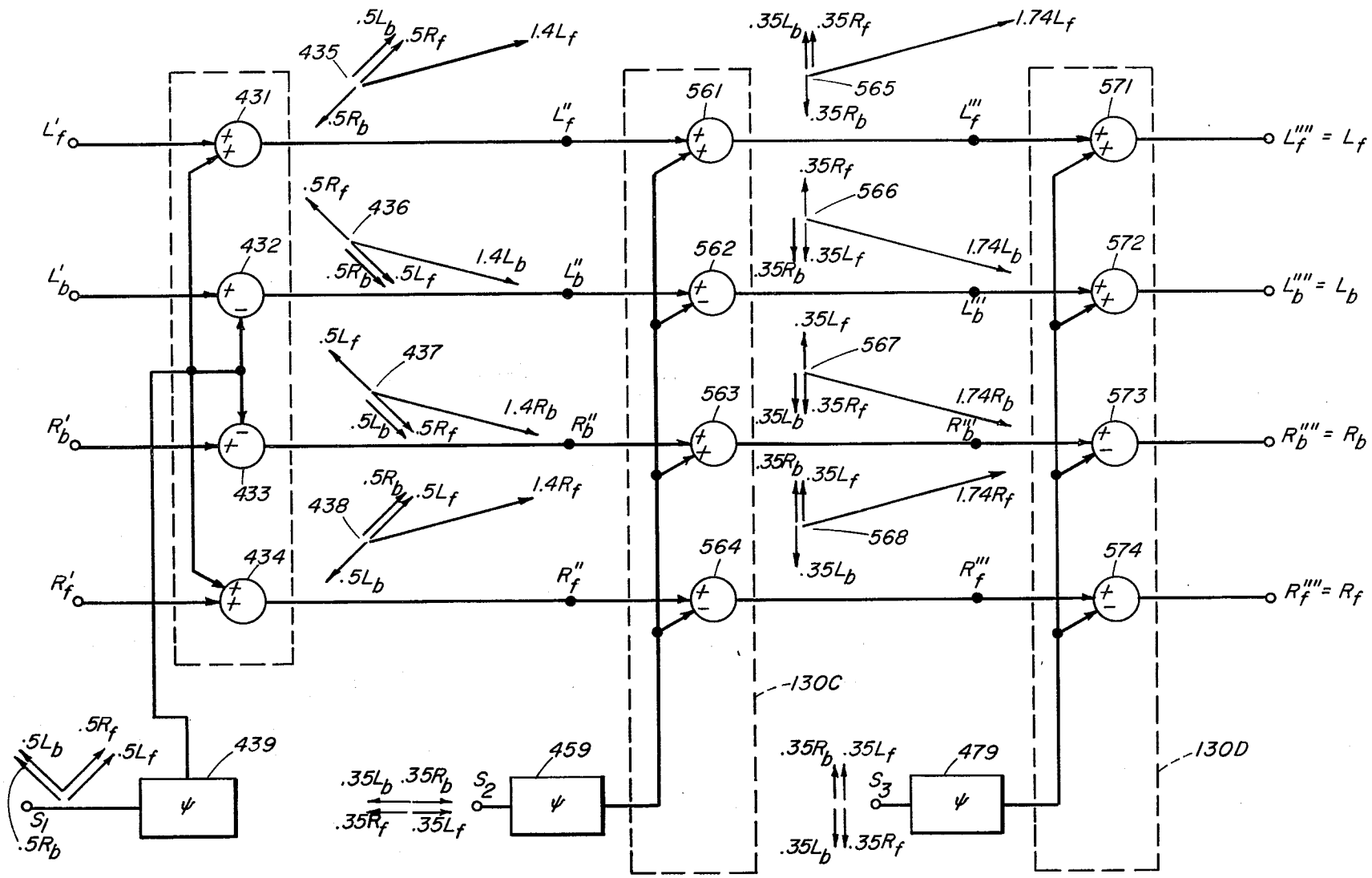
FIG. 9B is a diagram of the combining circuitry of FIG. 5 in accordance with still another embodiment of the invention.

FIGS. 9A and 9B illustrate a further embodiment of the invention wherein three auxiliary signals $S_1$, $S_2$ and $S_3$ are transmitted, and these auxiliary signals are utilized by consumers having certain types of combining circuitry 130 to recover either the original four independent audio signals in fully discrete form or enhanced versions of decoded SQ output signals. As in the previous embodiment, consumers have the option of purchasing only a portion of the total stages of combining circuitry 130 if they choose to be satisfied with enhanced audio output signals and do not require fully discrete outputs. Also, broadcasters have the option of transmitting signals which can be fully or partially discretized. FIG. 9A shows the portion of encoder block 20 (FIG. 1) which is used to generate $S_1$, $S_2$ and $S_3$ for this embodiment. $S_1$ is generated in the same way as set forth in the previous embodiment (FIG. 8A) so the prior description is applicable to the top portion of FIG. 9A. $S_2$ is generated using a pair of summing circuits 501 and 502 to respectively form the signals $(-0.35R_f - 0.35L_b)$ and $(0.35R_b + 0.35L_f)$. These signals are coupled through all-pass phase shift networks 503 and 504 which introduce a reference phase shift $\psi$ and the outputs of the phase shift networks are added by a summing circuit 505. The resultant auxiliary signal $S_2$ is represented by the phasor grouping 506 in the figure. The auxiliary signal $S_3$ is formed using summing circuits 511 and 512 to obtain the signals $(0.35R_f + 0.35L_b)$ and $(-0.35R_b - 0.35L_f)$, coupling these sum signals through all-pass phase shift networks 513 and 514 and then adding the outputs of the phase shift networks using the summing circuit 515. In this case the all-pass phase shift networks introduce a phase shift of $(\psi - 90°)$. The auxiliary signal $S_3$ is illustrated by the phasor grouping 516 in FIG. 9A.

At the receiver in the present embodiment, the detector 110 (FIG. 5) recovers $S_1$, $S_2$ and $S_3$ which are coupled via reference all-pass phase shift networks 439, 459 and 479, to combining circuit 130 along with the decoded SQ outputs $L_f'$, $L_b'$, $R_b'$ and $R_f'$. As shown in FIG. 9B, the combining circuit 130 consists of three stages designated 130A, 130C and 130D, each being shown in a dashed enclosure. The stage 130A is identical to the first stage of the previous embodiment as described in conjunction with FIG. 8B. As before, the outputs of this stage, $L_f''$, $L_b''$, $R_b''$ and $R_f''$ can be utilized as the final audio outputs by consumers whose combining circuitry consists solely of the stage 130A, these outputs exhibiting channel separation of 9dB for all adjacent channels. The more sophisticated equipment will have a second stage 130B which receives the four outputs and respectively couples them to four summing circuits designated 561 through 564. The auxiliary signal $S_2$, appropriately reference phase shifted, is added to $L_f''$ and $R_b''$ and subtracted from $L_b''$ and $R_f''$. The resultant outputs, designated $L_f'''$, $L_b'''$, $R_b'''$ and $R_f'''$ are respectively illustrated by the four phasor groupings 565 through 568 in FIG. 9B. Again, these signals can, if desired, be used as the final output signals as they provide a most satisfactory 14dB of separation between adjacent channels. The four signals can be completely discretized, however, using the stage 130D which includes four summing circuits designated 571 through 574. The summing circuits 571 and 572 respectively add $L_f'''$ to $S_3$ and $L_b'''$ to $S_3$ while the summing circuits 573 and 574 subtract $S_3$ from $R_b'''$ and $R_f'''$, respectively. The resultant outputs $L_f'\lambda'''$, $L_b''''$, $R_b''''$ and $R_f''''$ equal $L_f$, $L_b$, $R_b$, and $R_f$, the four original independent audio signals. The combining circuitry 130 of FIG. 9B is advantageous in that it requires only three all-pass phase shift networks.

While the invention has been described with reference to specific embodiments it will be appreciated that variations within the spirit and scope of the invention will occur to those skilled in the art. For example, while reference phase shifters (e.g. network 219 of FIG. 7B or networks 439 and 449 of FIG. 8B) have been described as being part of the receiver, with suitable standardization the appropriate reference phase shifts could be introduced at the transmitting end, thereby reducing receiver cost. Also, it will be understood that, if desired, the auxiliary signals can be transmitted at less than the full bandwidth of the primary information. It has been found that this technique can be employed to save bandwidth without severe degradation of the descretized signals.

I claim:

1. A compatible four channel system for use in conjunction with a radio transmission system for transmitting four individual audio signals designated $L_f$, $L_b$, $R_b$ and $R_f$ over a medium having primary and secondary information channels and first and second subsidiary information channels, said primary and secondary channels carrying information that is consistent and compatible with existing monophonic and stereophonic standards; comprising a. means for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other;

b. means for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other;

c. means for forming first and second conjugates of said first and second composite signals, respectively, said first and second conjugates being designated $L_T$* and $R_T$*;

d. means for forming a sum signal as a function of the sum of $L_T$ and $R_T$ and for applying said sum signal to the primary information channel;

e. means for forming a difference signal as a function of the difference between $L_T$ and $R_T$ and for applying said difference signal to said secondary information channel; and f. means for applying said first and second conjugates to said first and second subsidiary channels, respectively.

2. In a compatible four channel audio system for use in conjunction with a radio transmission system for transmitting four individual audio signals designated $L_f$, $L_b$, $R_b$, and $R_f$ over a medium having primary and secondary information channels and first and second subsidiary information channels, said primary and secondary channels carrying information that is consistent and compatible with existing monophonic and stereophonic standards, wherein the transmitter portion of said system comprises means for forming a first composite signal designated $L_T$ which contains, to the extent they are present, $L_f$ in a dominant proportion and $L_b$ and $R_b$ in subdominant proportions, $L_b$ and $R_b$ being phase shifted with respect to each other; means for forming a second composite signal designated $R_T$ which contains, to the extent they are present, $R_f$ in a dominant proportion and $L_b$ and $R_b$ in subdominant proportions, $L_b$ and $R_b$ being phase shifted with respect to each other; means for forming first and second conjugates of said first and second composite signals respectively; said first and second conjugates being designated $L_T$* and $R_T$*; means for forming a sum signal as a function of the sum of $L_T$ and $R_T$ and for applying said sum signal to the primary information channel; means for forming a difference signal as a function of the difference between $L_T$ and $R_T$ and for applying said difference signal to said secondary information channel; and means for applying said first and second conjugates to said first and second subsidiary channels, respectively, a receiver/decoder comprising:

a. means responsive to said primary and secondary channels for processing said sum and difference signals to obtain said first and second composite signals;

b. means for combining said first composite signal and said first conjugate to recover said first individual audio signal, $L_f$;

c. means for combining said second composite signal and said second conjugate to recover said second individual audio signal, $R_f$;

d. means for combining relatively phase shifted versions of said composite signals;

e. means for combining relatively phase shifted versions of said conjugates; and f. means for combining said combined relatively phase shifted composite signals and said combined relatively phase shifted conjugates to recover said third and fourth individual audio signals, $R_b$ and $L_b$.

3. A compatible four channel system for use in conjunction with a radio transmission system for transmitting four individual audio signals designated $L_f$, $L_b$, $R_b$, and $R_f$ over a medium having primary and secondary information channels and a subsidiary information channel, said primary and secondary channels carrying information that is consistent and compatible with existing monophonic and stereophonic standards, comprising:

a. means for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other;

b. means for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other;

c. means for forming an auxiliary signal which contains, to the extent they are present, the individual signals $L_b$ and $R_b$ only;

d. means for forming a sum signal as a function of the sum of $L_T$ and $R_T$ and for applying said sum signal to the primary information channel;

e. means for forming a difference signal as a function of the difference between $L_T$ and $R_T$ and for applying said difference signal to said secondary information channel; and f. means for applying said auxiliary signal to said subsidiary channel.

4. The system as defined by claim 3 wherein said auxiliary signal is formed by adding $L_b$ with $R_b$ without relative phase shift therebetween.

5. In a compatible four channel audio system for use in conjunction with a radio transmission system for transmitting four individual audio signals designated $L_f$, $L_b$, $R_b$ and $R_f$ over a medium having primary and secondary information channels and a subsidiary information channel, said primary and secondary channels carrying information that is consistent and compatible with existing monophonic and stereophonic standards, wherein the transmitter portion of said system comprises means for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other; means for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other; means for forming an auxiliary signal which contains, to the extent they are present, the individual audio signals $L_b$ and $R_b$ only; means for forming a sum signal as a function of the sum of $L_T$ and $R_T$ and for applying said sum signal to the primary information channels; means for forming a difference signal as a function of the difference between $L_T$ and $R_T$ and for applying said difference signal to said secondary information channel; and means for applying said auxiliary signal to said subsidiary channel; a receiver/decoder comprising:

a. means responsive to said primary and secondary channels for processing said sum and difference signals to obtain first and second composite signals;

b. matrix means for combining said first and second composite signals in predetermined amplitude and phase relationships to obtain four intermediate signals, each of which has a different one of said individual audio signals predominant;

c. means responsive to said subsidiary channel for recovering said auxiliary signal; and d. means for combining said auxiliary signal with each of said intermediate signals to obtain four output signals each having a different one of said individual audio signals predominant.

6. The receiver/decoder as defined by claim 5 wherein said means for combining said auxiliary signal with each of said intermediate signals comprises means for phase shifting said auxiliary signal and means for adding said phase shifted auxiliary signal to two of said intermediate signals and means for subtracting said phase shifted auxiliary signal from the other two of said intermediate signals.

7. A compatible four channel system for use in conjunction with a radio transmission system for transmitting four individual audio signals designated $L_f$, $L_b$, $R_b$, and $R_f$ over a medium having primary and secondary information channels and first, second, and third subsidiary information channels, said primary and secondary information channels carrying information that is consistent and compatible with existing monophonic and stereophonic standards, comprising:

a. means for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other;

b. means for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other;

c. means for forming first, second and third auxiliary signals, each of which contains, to the extent they are present, the individual audio signals $L_f$, $L_b$, $R_b$ and $R_f$ in predetermined amplitude and phase relationships;

d. means for forming a sum signal as a function of the sum of $L_T$ and $R_T$ and for applying said sum signal to the primary information channel;

e. means for forming a difference signal as a function of the difference between $L_T$ and $R_T$ and for applying said difference signal to said secondary information channel; and f. means for applying said first, second and third auxiliary signals to said first, second and third subsidiary channels respectively.

8. In a compatible four channel audio system for use in conjunction with a radio transmission system for transmitting four individual audio signals designated $L_f$, $L_b$, $R_b$ and $R_f$ over a medium having primary and secondary information channels and first, second and third subsidiary information channels, said primary and secondary channels carrying information that is consistent and compatible with existing monophonic and stereophonic standards, wherein the transmitter portion of said system comprises means for forming a first composite signal designated $L_T$ which contains, to the extent they are present, $L_f$ in a dominant proportion and $L_b$ and $R_b$ in sub-dominant proportions, $L_b$ and $R_b$ being phase shifted with respect to each other; means for forming a second composite signal designated $R_T$ which contains, to the extent they are present, $R_f$ in a dominant proportion and $L_b$ and $R_b$ in sub-dominant proportions, $L_b$ and $R_b$ being phase shifted with respect to each other; means for forming first, second and third auxiliary signals, each of which contains, to the extent they are present; the individual audio signals $L_f$, $L_b$, $R_b$ and $R_f$ in predetermined amplitude and phase relationships; means for forming a sum signal as a function of the sum of $L_T$ and $R_T$ and for applying said sum signal to the primary information channel; means for forming a difference signal as a function of the difference between $L_T$ and $R_T$ and for applying said difference signal to said secondary information channel; and means for applying said first, second and third auxiliary signals to said first, second and third subsidiary channels, respectively, a receiver/decoder comprising:

a. means responsive to said primary and secondary channels for processing said sum and difference signals to obtain said first and second composite signals;

b. matrix means for combining said first and second composite signals in predetermined amplitude and phase relationships to obtain four intermediate signals, each of which has a different one of said individual audio signals predominant;

c. means responsive to said first, second and third subsidiary channels for recovering said first, second and third auxiliary signals;

d. means for combining said first auxiliary signal with each of said intermediate signals to obtain four enhanced intermediate signals, each of which has a different one of said individual audio signals predominant;

e. means for combining said second auxiliary signal with each of said enhanced intermediate signals to obtain four further enhanced intermediate signals, each of which has a different one of said individual audio signals predominant; and f. means for combining said third auxiliary signal with each of said further enhanced intermediate signals to recover said first, second, third and fourth individual audio signals.

9. A compatible four channel system for use in conjunction with a radio transmission system for transmitting four individual audio signals designated $L_f$, $L_b$, $R_b$ and $R_f$ over a medium having primary and secondary information channels and first and second subsidiary information channels, said primary and secondary channels carrying information that is consistent and compatible with existing monophonic and stereophonic standards; comprising a. means for forming a first composite signal designated $L_T$ which contains, to the extent they are present, $L_f$ in a dominant proportion and $L_b$ and $R_b$ in subdominant proportions, $L_b$ and $R_b$ being phase shifted with respect to each other;

b. means for forming a second composite signal designated $R_T$ which contains, to the extent they are present, $R_f$ in a dominant proportion and $L_b$ and $R_b$ in subdominant proportions, $L_b$ and $R_b$ being phase shifted with respect to each other;

c. means for forming a first auxiliary signal by combining all of the individual audio signals, $L_f$, $L_b$, $R_b$ and $R_f$, in equal proportions, to the extent they are present;

d. means for forming a second auxiliary signal by combining all of the individual audio signals, $L_f$, $L_b$, $R_b$ and $R_f$, in substantially equal proportions, to the extent they are present, said individual audio signals being combined in different relative phase relationships in said first and second auxiliary signals;

e. means for forming a sum signal as a function of the sum of $L_T$ and $R_T$ and for applying said sum signal to the primary information channel;

f. means for forming a difference signal as a function of the difference between $L_T$ and $R_T$ and for applying said difference signal to said secondary information channel; and g. means for applying said first and second auxiliary signals to said first and second subsidiary channels, respectively.

10. A system as defined by claim 9 wherein said means for forming said first auxiliary signal includes means for adding the signals $L_b$ and $R_b$ in their original phase relationship and means for adding the signals $L_f$ and $R_f$ in their original phase relationship.

11. A system as defined by claim 10 wherein said means for forming said second auxiliary signal includes means for adding the signals $L_b$ and $R_b$ in phase opposition and means for adding the signals $L_f$ and $R_f$ in phase opposition.

12. In a compatible four channel audio system for use in conjunction with a radio transmission system for transmitting four individual audio signals designated $L_f$, $L_b$, $R_b$, and $R_f$ over a medium having primary and secondary information channels and first and second subsidiary information channels, said primary and secondary channels carrying information that is consistent and compatible with existing monophonic and stereophonic standards, wherein the transmitter portion of said system comprises means for forming a first composite signal designated $L_T$ which contains, to the extent they are present, $L_f$ in dominant proportion and $L_b$ and $R_b$ in subdominant proportions, $L_b$ and $R_b$ being phase shifted with respect to each other; means for forming a second composite signal designated $R_T$ which contains, to the extent they are present, $R_f$ in a dominant proportion and $L_b$ and $R_b$ in subdominant proportions, $L_b$ and $R_b$ being phase shifted with respect to each other;

means for forming first and second auxiliary signals, each of said auxiliary signals including all of the individual audio signals $L_f$, $L_b$, $R_b$ and $R_f$, in substantially equal proportions, to the extent they are present, with the individual audio signals being combined in different relative phase relationships in said first and second auxiliary signals; means for forming a sum signal as a function of the sum of $L_T$ and $R_T$ and for applying said sum signal to the primary information channel; means for forming a difference signal as a function of the difference between $L_T$ and $R_T$ and for applying said difference signal to said secondary information channel; and means for applying said first and second auxiliary signals to said first and second subsidiary channels, respectively, a receiver/decoder comprising:

a. means responsive to said primary and secondary channels for processing said sum and difference signals to obtain first and second composite signals;

b. matrix means for combining said first and second composite signals in predetermined amplitude and phase relationships to obtain four intermediate signals, each of which has a different one of said individual audio signals predominant;

c. means for combining one of said auxiliary signals with each of said intermediate signals to obtain four enhanced intermediate signals, each having a different one of said individual audio signals predominant; and d. means for combining the other auxiliary signal with each of said enhanced intermediate signals to recover said four individual audio signals in substantially their original form.

13. The receiver/decoder as defined by claim 12 wherein said means for combining one of said auxiliary signals with each of said intermediate signals comprises means for phase shifting said auxiliary signal, and means for adding said phase shifted auxiliary signal to two of said intermediate signals and for subtracting said phase shifted auxiliary signal from two of said intermediate signals.

* * * * *